US011725478B2

(12) United States Patent
Moreno

(10) Patent No.: US 11,725,478 B2
(45) Date of Patent: Aug. 15, 2023

(54) FLOW CONTROL DEVICE, METHOD, AND SYSTEM

(71) Applicant: Oscar Becerra Moreno, Houston, TX (US)

(72) Inventor: Oscar Becerra Moreno, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 20 days.

(21) Appl. No.: 17/506,178

(22) Filed: Oct. 20, 2021

(65) Prior Publication Data

US 2023/0117274 A1 Apr. 20, 2023

(51) Int. Cl.

| | |
|---|---|
| ***E21B 34/08*** | (2006.01) |
| ***E21B 34/12*** | (2006.01) |
| ***E21B 43/12*** | (2006.01) |

(52) U.S. Cl.

CPC ..... *E21B 34/08* (2013.01); *E21B 34/12* (2013.01); *E21B 43/12* (2013.01)

(58) Field of Classification Search

CPC ..... E21B 34/08; E21B 34/12; E21B 43/12

See application file for complete search history.

(56) References Cited

U.S. PATENT DOCUMENTS

| | | | |
|---|---|---|---|
| 4,295,529 A | 10/1981 | Stickland | |
| 2018/0156015 A1 | 6/2018 | Ding et al. | |

FOREIGN PATENT DOCUMENTS

| | | | | |
|---|---|---|---|---|
| CN | 112177569 A | * | 1/2021 | ..... E21B 34/08 |
| CN | 112627732 A | | 4/2021 | |
| JP | 2000002202 A | | 1/2000 | |
| KR | 102043315 B1 | | 11/2019 | |

OTHER PUBLICATIONS

Notification of Transmillal of the International Search Report and the Written Opinion of the International Searching Authority, or the Declaration; PCT/US2022/078209; dated Jan. 18, 2023; 10 pages.

* cited by examiner

*Primary Examiner* — George S Gray

(74) *Attorney, Agent, or Firm* — Cantor Colburn LLP

(57) ABSTRACT

A flow control device including a housing having a flow port therein, the flow port including a first end and a second end, a first gate having a specific gravity greater than water disposed in the housing adjacent a first end of the port and movable between a position of nonobstruction of the first end of the port and a position of obstruction of the first end of the port; and a second gate disposed in the housing, the second gate having a specific gravity about the same as a specific gravity of formation water in a formation in which the device is intended to be employed, the second gate disposed to control flow at the second end of the port.

15 Claims, 4 Drawing Sheets

FLOW CONTROL DEVICE, METHOD, AND SYSTEM

BACKGROUND

In the resource recovery industry, the control of fluids entering the production system is of significant concern. It is well known that water may be produced from certain zones over time and the production of water is a detractor from profitability of a well. Exclusion of water from a production fluid is desirable and more so an automatic exclusion and reset is prized by the industry, though it has yet to satisfactorily fulfill this need. The art would therefore well receive alternate flow control configurations that enhance the production value of a well.

SUMMARY

An embodiment of a flow control device including a housing having a flow port therein, the flow port including a first end and a second end, a first gate having a specific gravity greater than water disposed in the housing adjacent a first end of the port and movable between a position of nonobstruction of the first end of the port and a position of obstruction of the first end of the port; and a second gate disposed in the housing, the second gate having a specific gravity about the same as a specific gravity of formation water in a formation in which the device is intended to be employed, the second gate disposed to control flow at the second end of the port.

A method for controlling flow including flowing a fluid through a device including a housing having a flow port therein, the flow port including a first end and a second end, a first gate having a specific gravity greater than water disposed in the housing adjacent a first end of the port and movable between a position of nonobstruction of the first end of the port and a position of obstruction of the first end of the port; and a second gate disposed in the housing, the second gate having a specific gravity about the same as a specific gravity of formation water in a formation in which the device is intended to be employed, the second gate disposed to control flow at the second end of the port, the device disposed with a longitudinal axis thereof in a highly deviated or horizontal position, the device further comprising at least one port at a gravitationally higher position and at least one port at a gravitationally lower position of the device, moving the first gate toward a position less obstructive to the gravitationally higher positioned port and more obstructive to the gravitationally lower port if the flowing fluid is of a specific gravity less than the first gate and toward a position more obstructive to the gravitationally higher port and less obstructive to the gravitationally lower port if the flowing fluid is of a specific gravity more than the first gate; and moving the second gate toward a position less obstructive to the port if the flowing fluid is of a specific gravity less than the second gate and toward a position more obstructive to the port if the flowing fluid is of a specific gravity more than the second gate.

A wellbore system includes a borehole in a subsurface formation, a string in the borehole; and a flow control device including a housing having a flow port therein, the flow port including a first end and a second end, a first gate having a specific gravity greater than water disposed in the housing adjacent a first end of the port and movable between a position of nonobstruction of the first end of the port and a position of obstruction of the first end of the port; and a second gate disposed in the housing, the second gate having a specific gravity about the same as a specific gravity of formation water in a formation in which the device is intended to be employed, the second gate disposed to control flow at the second end of the port, disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
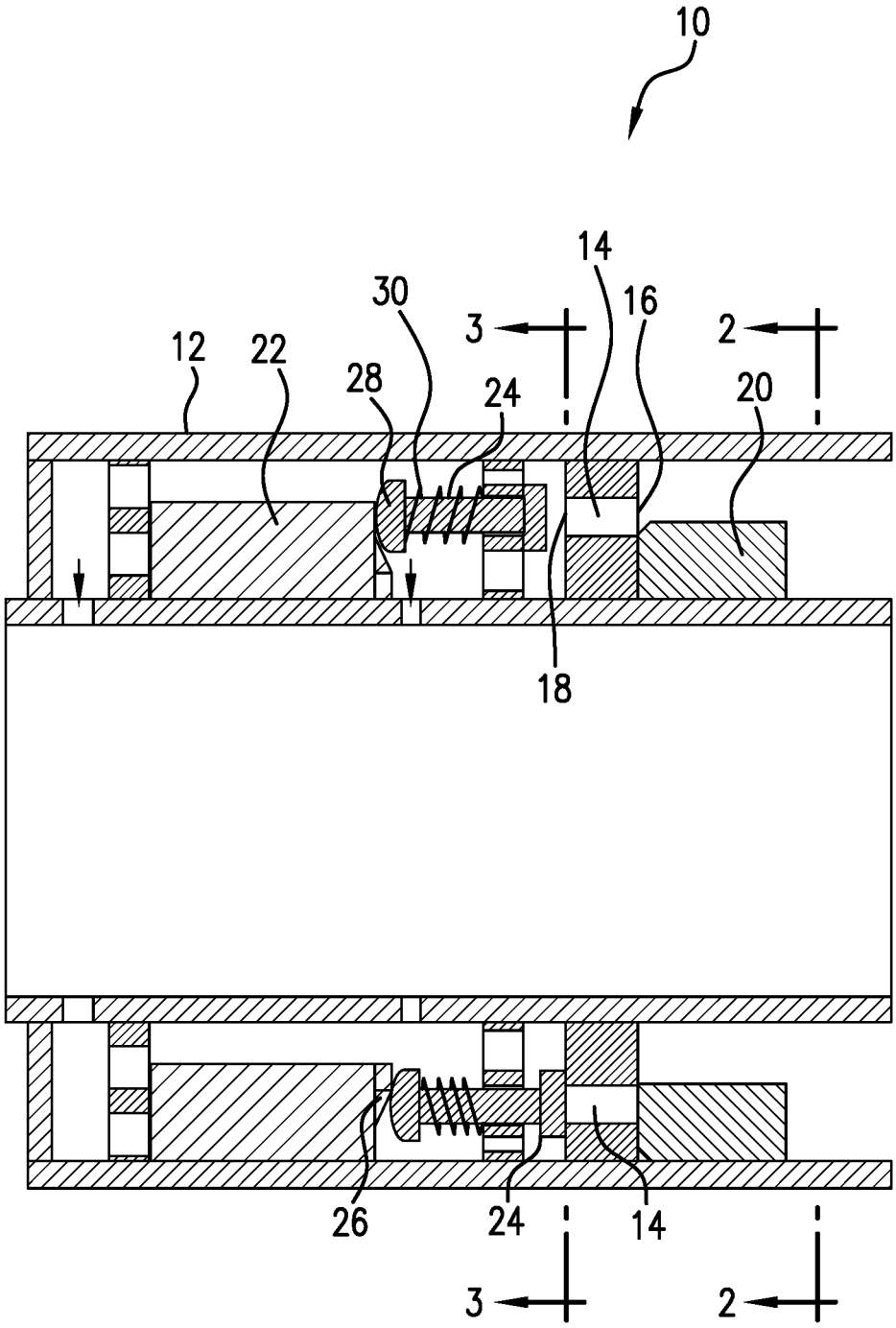
FIG. 1 is a cross sectional view of an embodiment of a flow control device as disclosed herein.

Referring to FIG. 1, a flow control device 10 is illustrated. The device 10 comprises a housing 12 having a flow port 14 therein. The flow port 14 is, in an embodiment, longitudinally oriented. In each embodiment, the port 14 is possessed of a first end 16 and a second end 18. A first gate 20 is disposed in the housing 12 adjacent the first end 18 of the port 14. The gate 20 is located in proximity to end 18 such that depending upon orthogonal position of the gate 20 relative to the housing 12, the gate will present an impediment to flow through the port 14. First gate 20 is, in the illustrated embodiment, shaped as a ring though the shape could be easily adapted. The first gate 20 comprises a material having a specific gravity that is ideally lower than drilling mud intended for use in a specific well in which this flow control device is intended for use and higher than that of water. Accordingly, the gate 20 will sink in water but float in mud (the mud slated for the use of this device, which is particular to a specific well). It is to be appreciated however that the specific gravity of the mud could be ignored in embodiments, leaving gate 20 configured to react to water. In embodiments, both specific gravities are contemplated. These are generally known from logging operations during drilling of the well. In embodiments where the first gate 20 is also of a specific gravity that is less than mud, the configuration supports an operation where mud may be circulated out of the wellbore, as needed. If the gate 20 were lighter than the mud then the device would automatically close due to exposure to mud. This would be undesirable in some cases where mud circulation is important to the system. Materials for the gate 20 include metal, composites, etc.

Figure 2:
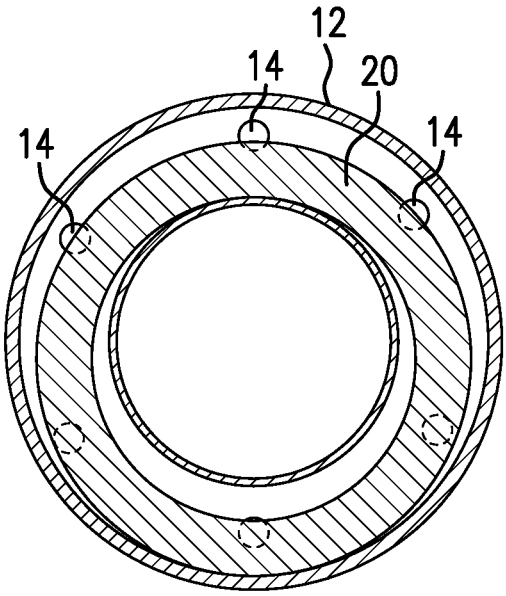
FIG. 2 is a cross section view of the device of FIG. 1 taken along section line 2-2.

When the device 10 is in a highly deviated or horizontal position (illustrated in FIG. 1), the gate 20 will assume the position as illustrated in FIGS. 1 and 2. It will be apparent that in this position, almost all of an uppermost port 14 and about half of two others are open to flow. This is a position in which the flow is predominantly something having a specific gravity less than that of the gate 20 (e.g., oil).

In addition to first gate 20, the device 10 also includes a second gate 22 disposed within the housing. The second gate 22 is located in proximity to end 16 of port 14 (the opposite end from end 18) such that depending upon orthogonal position of the gate 20 relative to the housing 12, the gate will present an impediment to flow through the port 14 at end 16. Accordingly, in some positions, both gates 20 and 22 will simultaneously present impediment to fluid flow through port 14. Second gate 22 is configured with a specific gravity of slightly lower than the water that is already in the formation in which the device is to be used (known from logging as noted above). For clarity, "slightly lower" means any amount lower since if the specific gravity is lower than the water in situ, the ring will float. If the difference in specific gravity is small, floating will occur slower, if the difference is greater, floating will occur more quickly. Hence, determination of how much difference there is in specific gravity depends upon other factors such as how fast one wants the second gate 22 to react to water and shut off. Overall, this gate works similarly to gate 20. When it floats on the fluid flowing through the device 10, that flow is inhibited. When it sinks, flow is better enabled through port 14 at the high side of the device 10.

Figure 3:
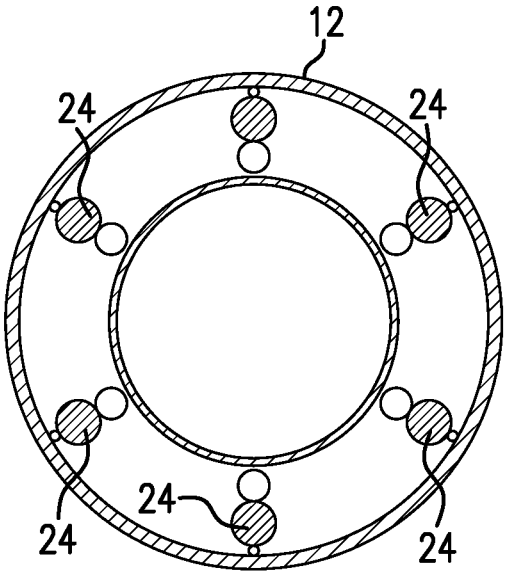
FIG. 3 is a cross section view of the device of FIG. 1 taken along section line 3-3.

In the embodiment of FIGS. 1-3, there is another active component in the device 10. This is a valve 24. The valve 24 is actuated by a cam surface 26 on the gate 22. It should be noted that the cam surface 26 is disposed near an inside dimension of the gate 22 and actuates the valve by being moved radially outwardly by the gate 22 pursuant to the specific gravity of the fluid flowing through the device 10. In the illustration for FIG. 1, the gate 22 is sunken and hence the cam on the bottom is actuating the valve 24. That valve 24 hence is urged into a seated position against the port 14 thereby assisting to close off flow through that port 14. This is beneficial especially when the device 10 happens to be located in a fluid environment where a fluid interface occurs between the high side and low sides of the device 10. In the valve closed position, water being of a higher cut at the low side of device 10 is almost completely shut off.

The valve 24 may in some cases be configured as a poppet-type valve having a poppet 28 and may include an optional biaser/biasing member 30.

Considering FIGS. 2 and 3, it will be apparent that different valves 24 will be actuated depending upon the specific gravity of the fluid flowing in the device 10 and of course the orientation of the device relative to gravity in the borehole.

Figure 4:
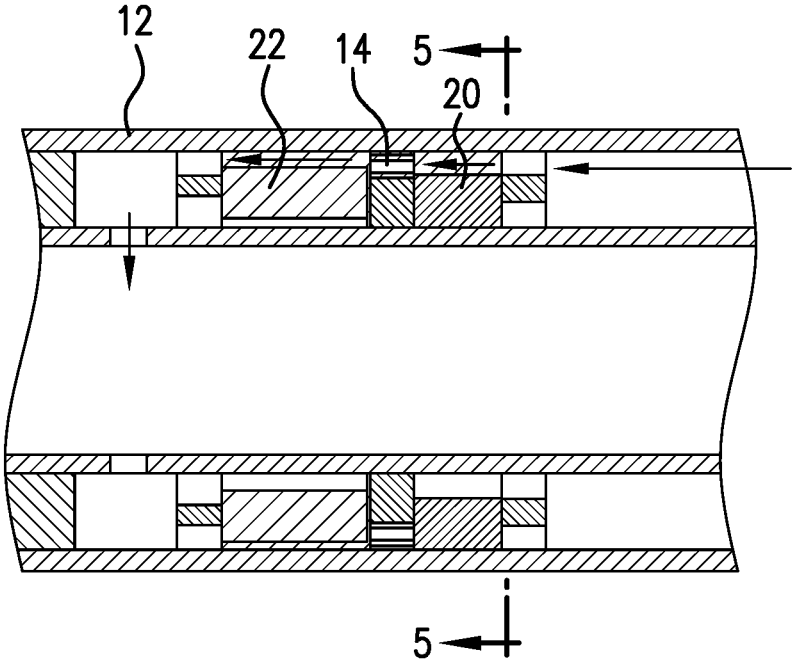
FIG. 4 is a cross sectional view of another embodiment of a flow control device as disclosed herein.
Figure 5:
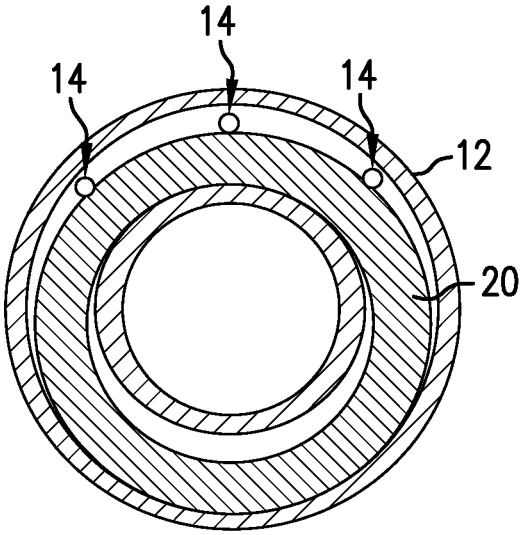
FIG. 5 is a cross section view of the device of FIG. 4 taken along section line 5-5.

Referring to FIGS. 4 and 5, another embodiment of a device 40 is illustrated that is substantially similar to device 10 but omits the valve 24. Other components are similar carry identical numerals. Flow control relies upon obstruction via the gates 20 and 22 alone to control flow of undesirable fluids based upon their specific gravities.

In each of the embodiments, a small amount of flow will continue since it is this flow that dictates the automatic control nature of the disclosure hereof. Since the gates 20 and 22 respond to specific gravity of the fluid, there must remain some flow to allow for automatic adjustment of the device 10, 40 after initial closure. If there were no flow at all when closed, then the fluid composition would not change in the fluid contacting the gates 20, 22 and they would never experience a specific gravity of fluid that could make them reset. With a small leak however, if the water cut goes back down, for example, meaning the oil cut goes up and the specific gravity of the fluid is lower, the devices 10,40 will automatically reopen due to the gates 20,22 sinking.

Figure 6:
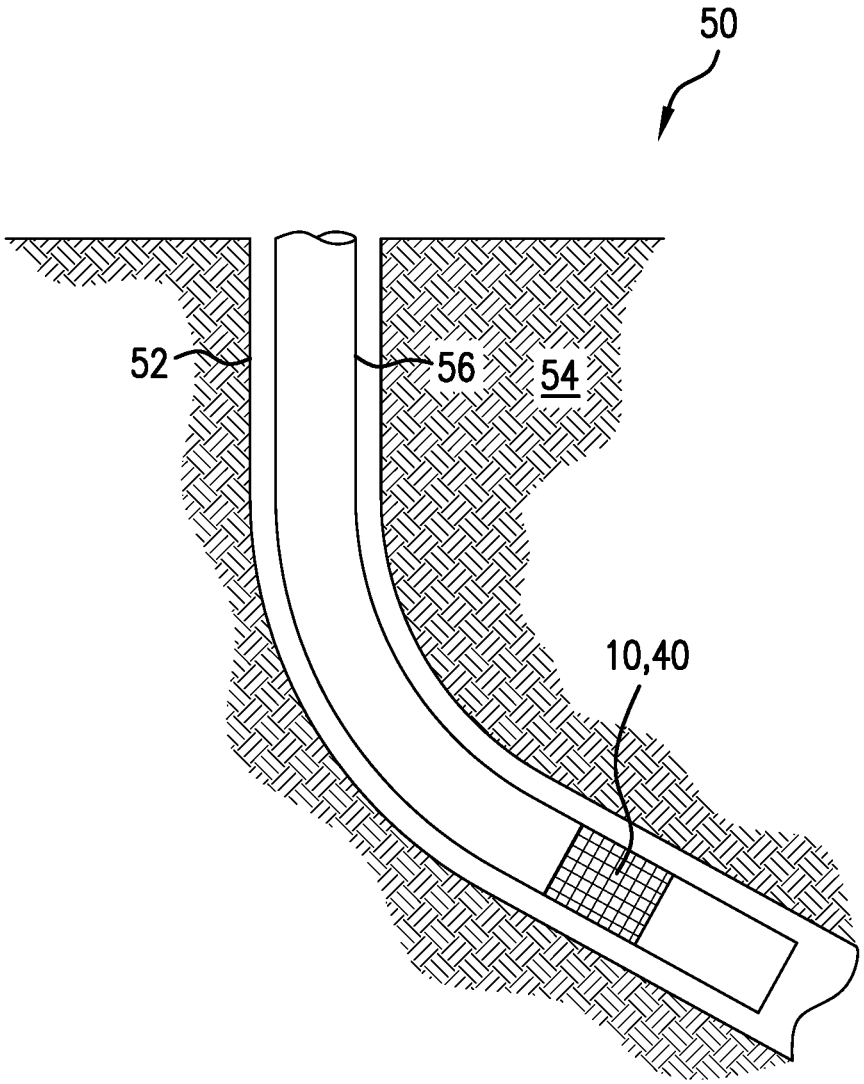
FIG. 6 is a v of a wellbore system including a flow control device as disclosed herein

Referring to FIG. 6, a well bore system 50 is illustrated schematically. The system 50 comprises a borehole 52 in a subsurface formation 54. A string 56 is disposed in the borehole 52. A device 10, 40 is disposed within or as a part of the string 56.

Set forth below are some embodiments of the foregoing disclosure:

Embodiment 1: A flow control device including a housing having a flow port therein, the flow port including a first end and a second end, a first gate having a specific gravity greater than water disposed in the housing adjacent a first end of the port and movable between a position of nonobstruction of the first end of the port and a position of obstruction of the first end of the port; and a second gate disposed in the housing, the second gate having a specific gravity about the same as a specific gravity of formation water in a formation in which the device is intended to be employed, the second gate disposed to control flow at the second end of the port.

Embodiment 2: The flow control device as in any prior embodiment further including a valve at the port, the valve actuated by the second gate.

Embodiment 3: The flow control device as in any prior embodiment wherein the valve includes a biaser/biasing member.

Embodiment 4: The flow control device as in any prior embodiment wherein the biaser/biasing member biases the valve to an open position.

Embodiment 5: The flow control device as in any prior embodiment wherein the valve is a poppet valve.

Embodiment 6: The flow control device as in any prior embodiment wherein the port is a group of ports distributed about a circumference of the housing.

Embodiment 7: The flow control device as in any prior embodiment wherein at least one of the first gate and the second gate is a ring.

Embodiment 8: The flow control device as in any prior embodiment wherein at least one of the first gate and the second gate is movable orthogonally within and relative to the housing.

Embodiment 9: The flow control device as in any prior embodiment wherein the second gate includes a cam surface interactive with the valve.

Embodiment 10: The flow control device as in any prior embodiment wherein at least one of the first gate and the second gate comprises metal.

Embodiment 11: A method for controlling flow including flowing a fluid through a device as in any prior embodiment, the device disposed with a longitudinal axis thereof in a highly deviated or horizontal position, the device further comprising at least one port at a gravitationally higher position and at least one port at a gravitationally lower position of the device, moving the first gate toward a position less obstructive to the gravitationally higher positioned port and more obstructive to the gravitationally lower port if the flowing fluid is of a specific gravity less than the first gate and toward a position more obstructive to the gravitationally higher port and less obstructive to the gravitationally lower port if the flowing fluid is of a specific gravity more than the first gate; and moving the second gate toward a position less obstructive to the port if the flowing fluid is of a specific gravity less than the second gate and toward a position more obstructive to the port if the flowing fluid is of a specific gravity more than the second gate.

Embodiment 12: The method as in any prior embodiment further including actuating a valve with the second gate if the flowing fluid is of a specific gravity than more than the second gate.

Embodiment 13: The method as in any prior embodiment wherein the actuating is camming the valve with the second gate.

Embodiment 14: The method as in any prior embodiment wherein the camming is to a closed position of the valve.

Embodiment 15: A wellbore system includes a borehole in a subsurface formation, a string in the borehole; and a flow control device as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A flow control device comprising:

a housing having a flow port therein, the flow port including a first end and a second end;

a first gate having a specific gravity greater than water disposed in the housing adjacent the first end of the port and movable between a position of nonobstruction of the first end of the port and a position of obstruction of the first end of the port; and a second gate disposed in the housing, the second gate having a specific gravity about the same as a specific gravity of formation water in a formation in which the device is intended to be employed, the second gate disposed to control flow at the second end of the port.

2. The device as claimed in claim 1 further including a valve at the port, the valve actuated by the second gate.

3. The device as claimed in claim 2 wherein the valve includes a biaser to operably bias the valve to a position.

4. The device as claimed in claim 3 wherein the biaser biases the valve to an open position.

5. The device as claimed in claim 2 wherein the valve is a poppet valve.

6. The device as claimed in claim 2, wherein the second gate includes a cam surface interactive with the valve.

7. The device as claimed in claim 1, wherein the port is a group of ports distributed about a circumference of the housing.

8. The device as claimed in claim 1, wherein at least one of the first gate or the second gate is a ring.

9. The device as claimed in claim 1, wherein at least one of the first gate or the second gate is movable orthogonally within and relative to the housing.

10. The device as claimed in claim 1, wherein at least one of the first gate or the second gate comprises metal.

11. A method for controlling flow comprising:

flowing a fluid through a device as claimed in claim 1, the device disposed with a longitudinal axis thereof in a deviated or horizontal position, the port being a plurality of ports, one or more of the plurality of ports being at a gravitationally higher position and one or more of the plurality of ports being at a gravitationally lower position of the device;

moving the first gate toward a position less obstructive to the gravitationally higher positioned one or more of the plurality of ports and more obstructive to the gravitationally lower positioned one or more of the plurality of ports if the flowing fluid is of a specific gravity less than the first gate and toward a position more obstructive to the gravitationally higher positioned one or more of the plurality of ports and less obstructive to the gravitationally lower positioned one or more of the plurality of ports if the flowing fluid is of a specific gravity more than the first gate; and moving the second gate toward a position less obstructive to the gravitationally higher positioned one or more of the plurality of ports if the flowing fluid is of a specific gravity less than the second gate and toward a position more obstructive to the gravitationally higher positioned one or more of the plurality of ports if the flowing fluid is of a specific gravity more than the second gate.

12. The method as claimed in claim 11 further comprising actuating a valve with the second gate if the flowing fluid is of a specific gravity more than the second gate.

13. The method as claimed in claim 11 wherein the actuating is camming the valve with the second gate.

14. The method as claimed in claim 13 wherein the camming is to a closed position of the valve.

15. A wellbore system comprising:

a borehole in a subsurface formation;

a string in the borehole; and a flow control device as claimed in claim 1 disposed within or as a part of the string.

* * * * *